US007163118B2

(12) United States Patent
Cheng

(10) Patent No.: US 7,163,118 B2
(45) Date of Patent: Jan. 16, 2007

(54) RECEPTACLE PARTITIONING STRUCTURE

(75) Inventor: Chen Kung Cheng, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 335 days.

(21) Appl. No.: 10/630,701

(22) Filed: Jul. 31, 2003

(65) Prior Publication Data

US 2004/0144789 A1 Jul. 29, 2004

(30) Foreign Application Priority Data

Jan. 28, 2003 (TW) ..... 92201562 U

(51) Int. Cl.
*B65D 1/24* (2006.01)
*B65D 1/36* (2006.01)
*B65D 25/04* (2006.01)

(52) U.S. Cl. ..... 220/528; 220/529; 206/561

(58) Field of Classification Search ..... 220/510, 220/528, 529, 531, 532, 533, 552, 677, 682, 220/690; 403/294; 312/348.2, 348.3, 330.1; 206/561; 229/120.31, 120.34; 190/109, 190/110

See application file for complete search history.

(56) References Cited

U.S. PATENT DOCUMENTS 1,523,136 A * 1/1925 O'Connor ..... 220/533
4,499,997 A * 2/1985 Swingley, Jr. ..... 206/509
6,493,917 B1 * 12/2002 Sunka ..... 29/413
2003/0164665 A1 * 9/2003 Guay et al. ..... 312/348.3

* cited by examiner

*Primary Examiner*—Nathan J. Newhouse
*Assistant Examiner*—Harry Grosso
(74) *Attorney, Agent, or Firm*—Troxell Law Office, PLLC

(57) ABSTRACT

A receptacle partitioning structure disposed in a receptacle defining an interior rectangular solid space and having an upper opening. The receptacle partitioning structure includes: a pair of first assembling bodies oppositely disposed on inner edges of the receptacle, each of two ends of each first assembling body being formed with a perforation, a middle section of the first assembling body being formed with at least one first insertion slit; a pair of second assembling bodies, two ends of each second assembling body being respectively formed with two bending sections transversely extending by a certain length in reverse directions; and a partitioning slat. The bending sections of the second assembling bodies are inserted in the perforations of the first assembling bodies, whereby the first and second assembling bodies can be readily, conveniently and firmly assembled into a rectangular frame. Two ends of the first partitioning slat are respectively inserted in the first insertion slits to partition the interior space of the receptacle into several compartments for accommodating different sorts of articles.

2 Claims, 6 Drawing Sheets

RECEPTACLE PARTITIONING STRUCTURE

BACKGROUND OF THE INVENTION

The present invention is related to a partitioning structure, and more particularly to a partitioning structure disposed in a receptacle to partition the interior space thereof into several compartments.

A receptacle such as a drawer generally has a rectangular interior space. Various kinds of articles are collectively placed in the interior space. After the receptacle is transferred or the articles in the receptacle are moved, it often takes place that the articles are tangled or overlapped with each other. As a result, a user can hardly find a necessary article from the tangling articles. Also, the interior space of the receptacle is wasted.

In order to solve the above problems, in some receptacles, two opposite sides of the receptacle are formed with several insertion channels at intervals. Two ends of a partitioning plate are inserted in the insertion channels to partition the interior space of the receptacle. A user can conveniently place different sorts of articles in different compartments. However, it is troublesome and complicated to manufacture the receptacle with the insertion channels on two opposite sides. Therefore, it is hard to mass-produce the receptacles.

FIG. 1 shows a receptacle partitioning structure including four slat bodies 91 which are independently made and disposed along inner edges of the receptacle 92. Each slat body 91 is formed with several insertion channels at intervals. Two ends of a partitioning plate 93 are inserted in the insertion channels. Such slat body and partitioning plate can be mass-produced and can be added to those receptacles which are originally formed without any insertion channel.

However, the slat bodies 91 are simply placed along the inner edges of the receptacle 93 to form a rectangular structure. The four corners of the rectangular structure are not interconnected. Therefore, the rectangular structure is unstable and cannot be reliably located. Moreover, in use, it often takes place that one or two or all the slat bodies 91 of the unstable structure fall down. This leads to trouble in use of such partitioning plate.

SUMMARY OF THE INVENTION

It is therefore a primary object of the present invention to provide a receptacle partitioning structure which can be readily assembled and independently and firmly disposed in a receptacle to partition the interior space thereof into several compartments for accommodating different sorts of articles.

It is a further object of the present invention to provide the above receptacle partitioning structure which can be mass-produced at lower cost.

According to the above objects, the receptacle partitioning structure is disposed in a receptacle defining an interior rectangular solid space and having an upper opening. The receptacle partitioning structure includes a pair of first assembling bodies, a pair of second assembling bodies and a partitioning slat. Each of two ends of each first assembling body is formed with a perforation. A middle section of the first assembling body is formed with at least one first insertion slit. Two ends of each second assembling body are respectively formed with two bending sections transversely extending by a certain length in reverse directions. The bending sections of the second assembling bodies are inserted in the perforations of the first assembling bodies. Two ends of the first partitioning slat are respectively inserted in the first insertion slits.

The present invention can be best understood through the following description and accompanying drawings wherein:

DETAILED DESCRIPTION OF THE PREFERRED EMBODIMENTS

Figure 1:
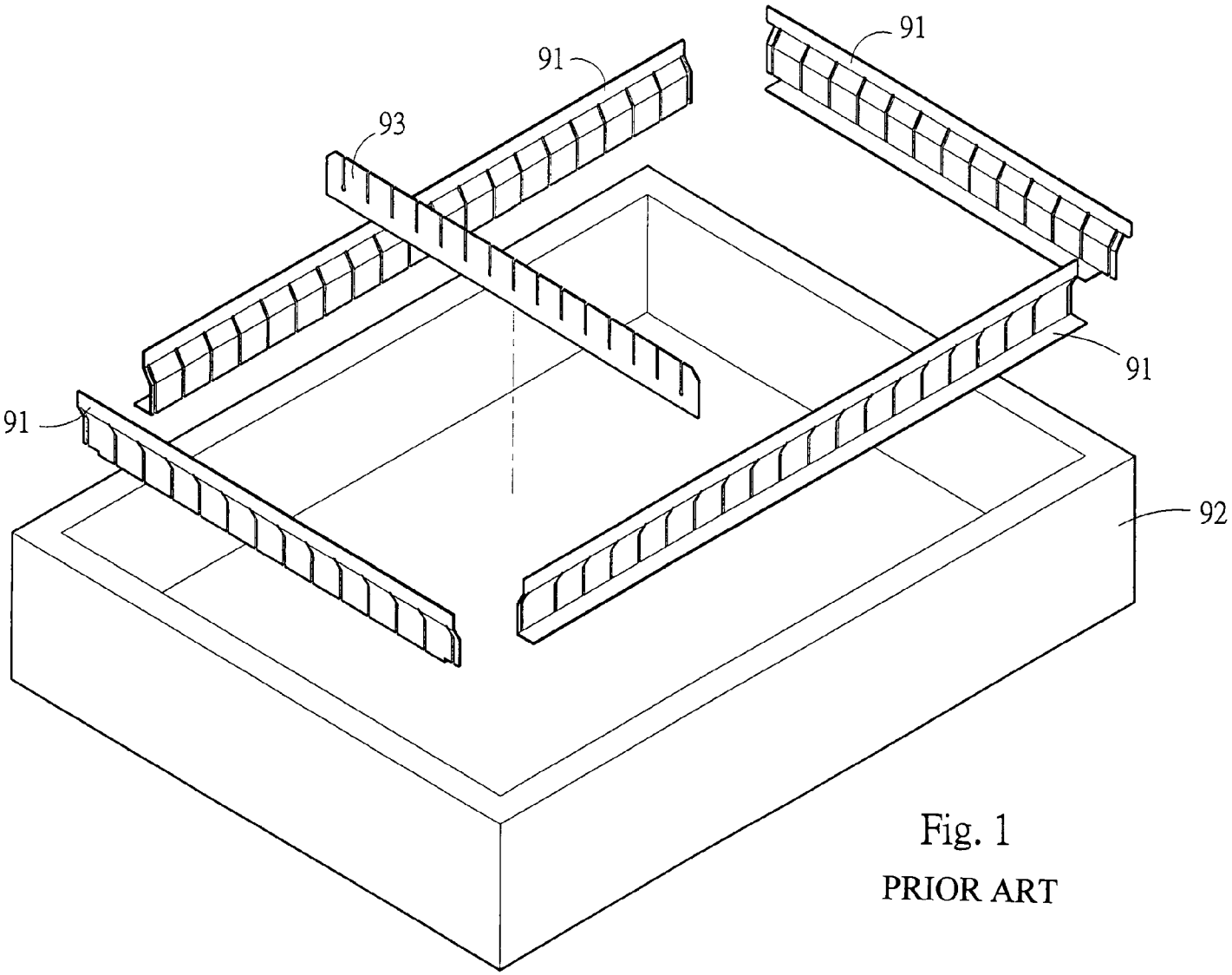
Fig. 1 PRIOR ART
FIG. 1 is a perspective exploded view of a conventional receptacle partitioning structure.
Figure 2:
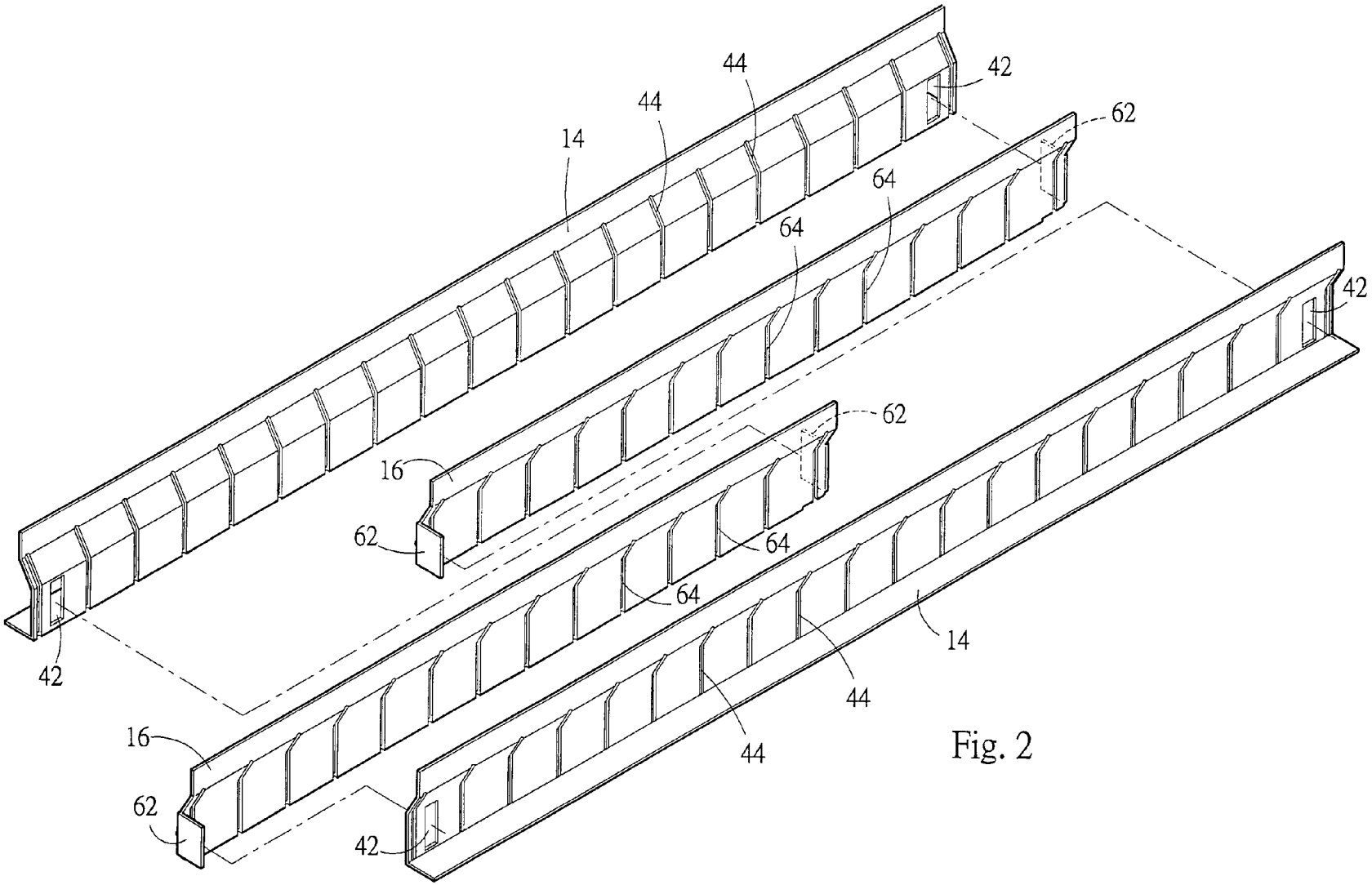
FIG. 2 is a perspective exploded view of a preferred embodiment of the receptacle partitioning structure of the present invention, in which the first and second assembling bodies have not yet assembled.
Figure 3:
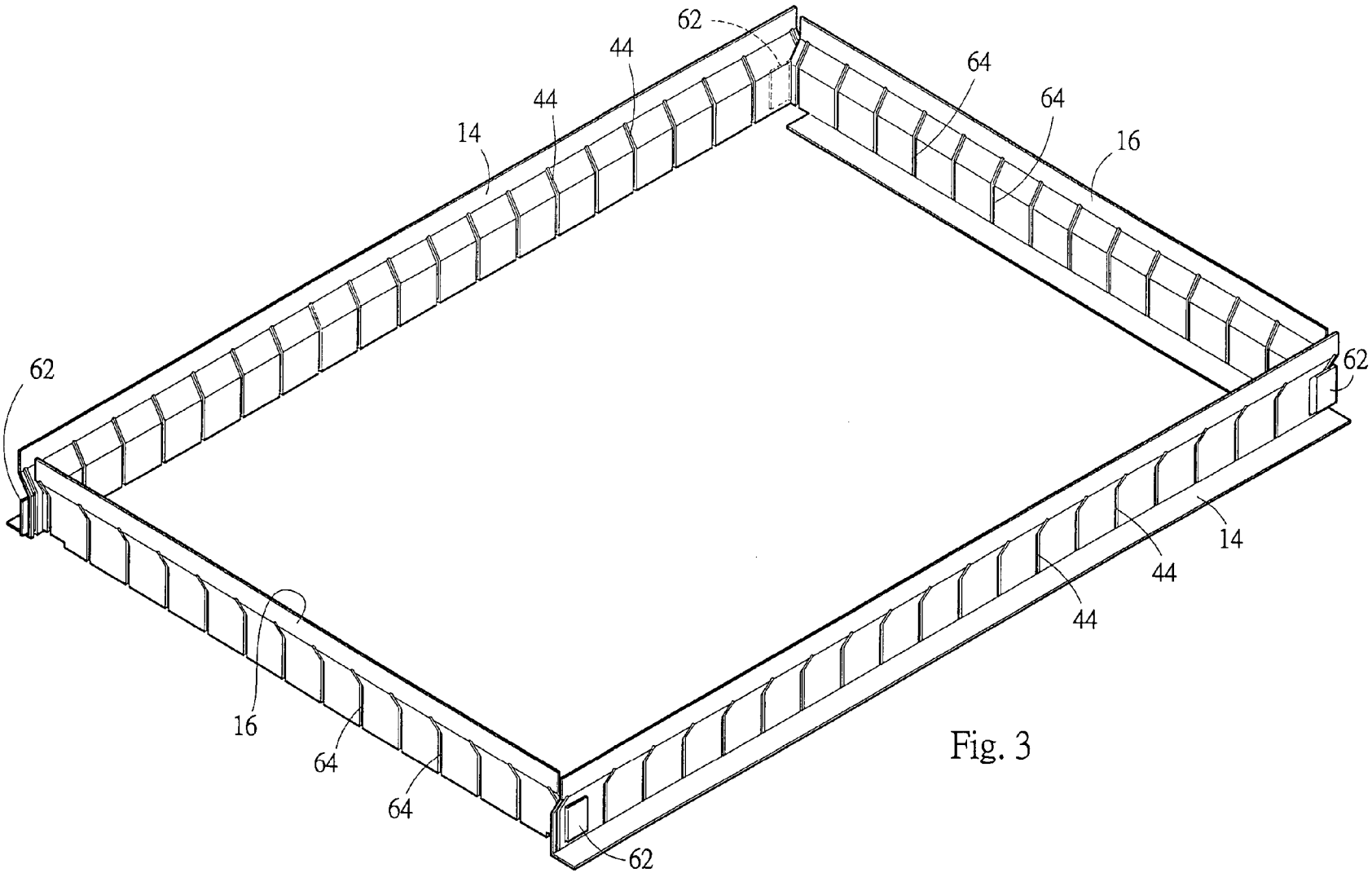
FIG. 3 is a perspective assembled view of the preferred embodiment of the receptacle partitioning structure of the present invention, in which the first and second assembling bodies are assembled into a rectangular frame.
Figure 4:
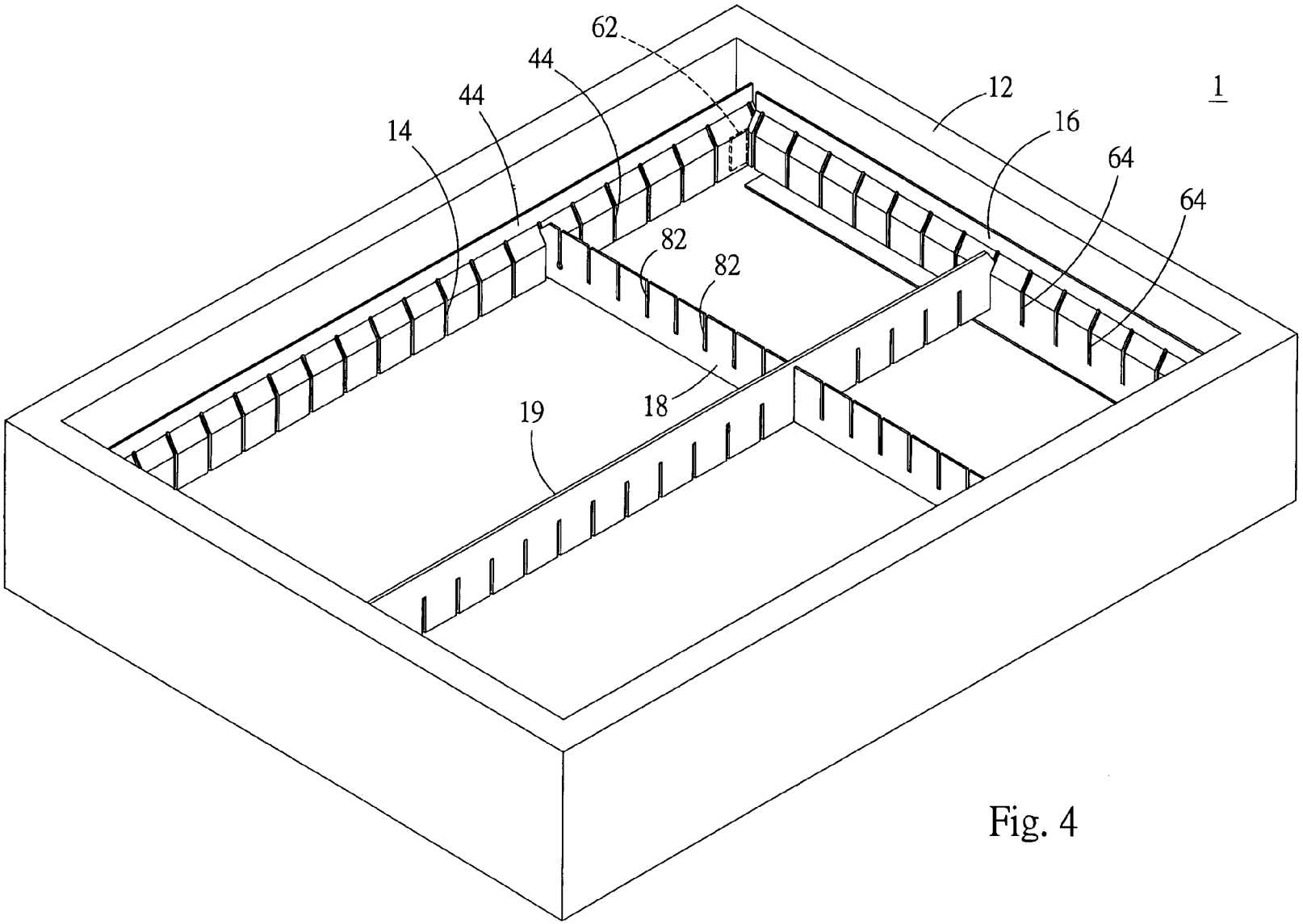
FIG. 4 is a perspective assembled view of the preferred embodiment of the receptacle partitioning structure of the present invention, in which the rectangular frame is placed on inner edges of the receptacle.
Figure 5B:
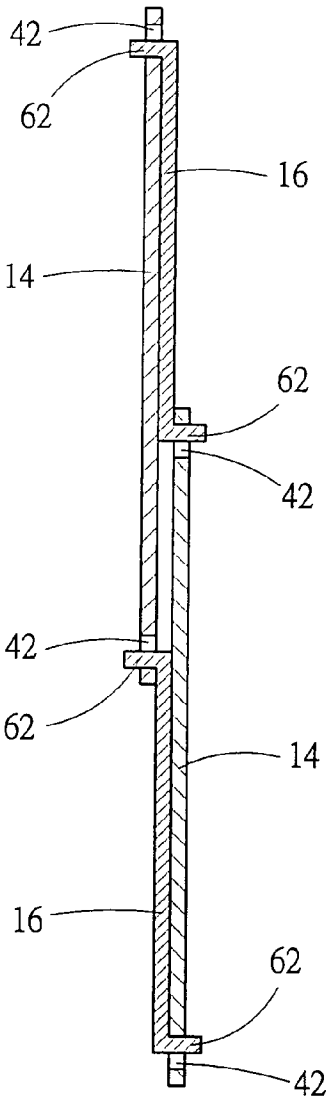
FIGS. 5A to 5D show the assembling procedure of the receptacle partitioning structure of the present invention.
Figure 5A:
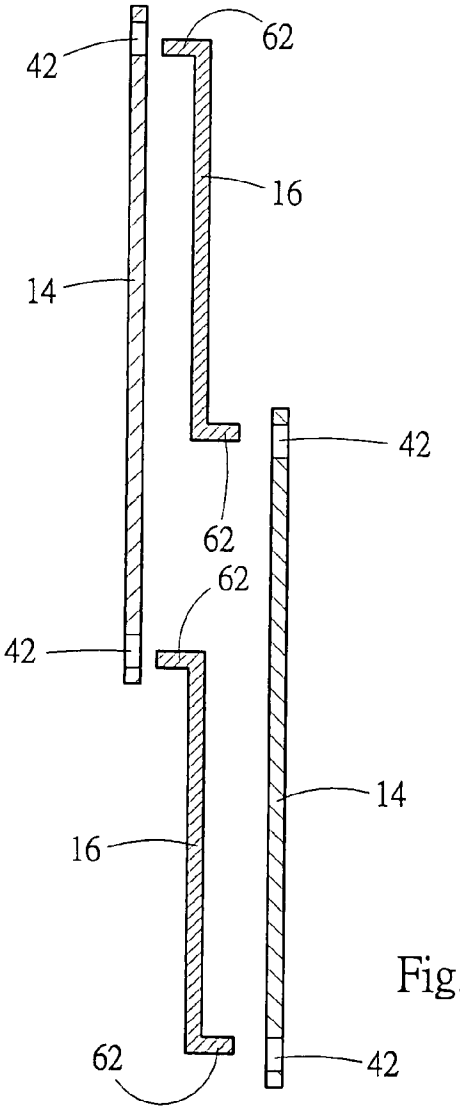
Figure 5D:
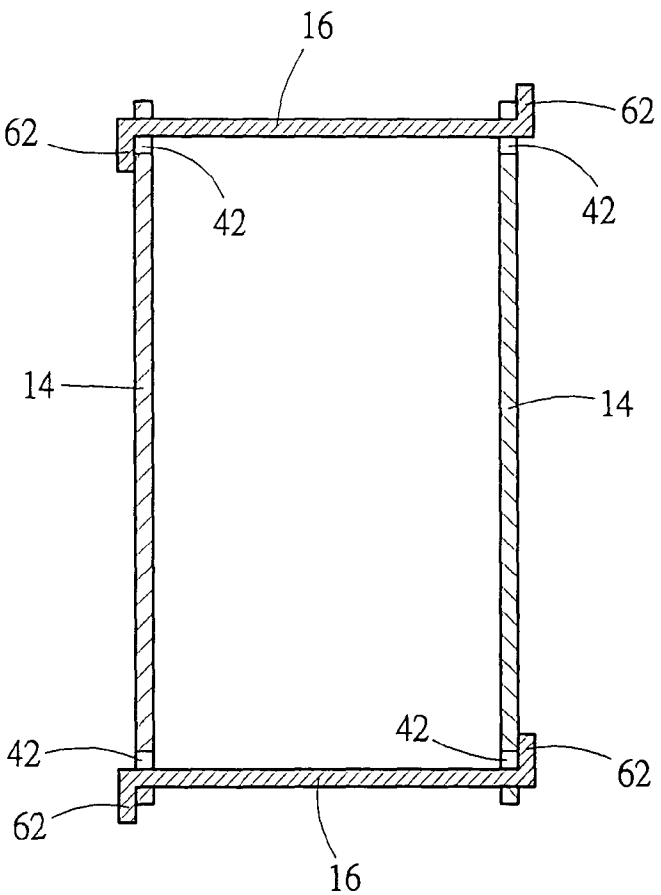
Figure 5C:
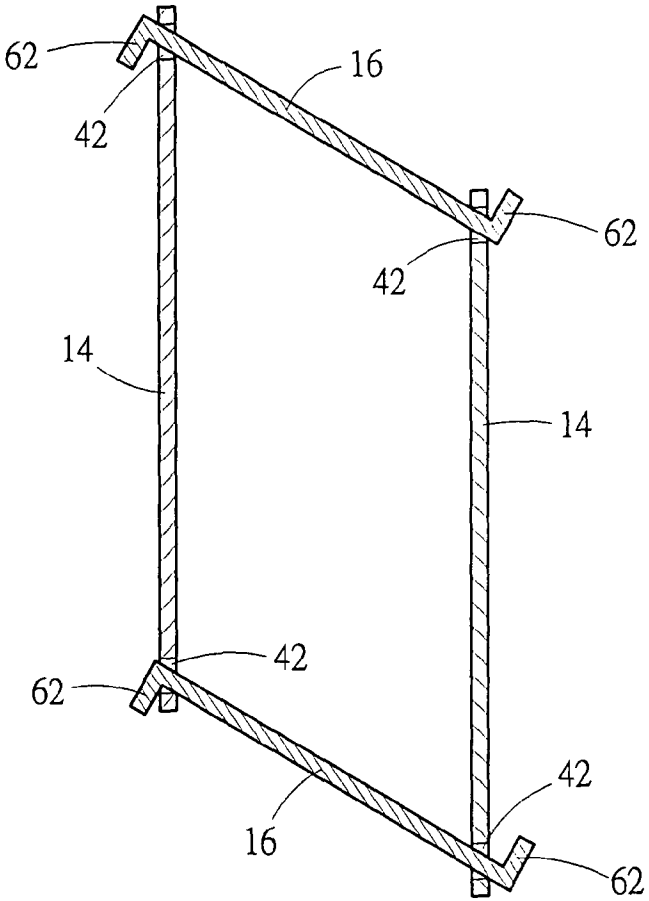

Please refer to FIGS. 2 to 4. The receptacle partitioning structure 1 of the present invention includes a receptacle 12, a pair of first assembling bodies 14, a pair of second assembling bodies 16 and a first partitioning slat 18.

The receptacle 12 is a rectangular solid body defining an interior rectangular solid space and having an upper opening.

The pair of first assembling bodies 14 are slat bodies with predetermined length. The pair of first assembling bodies 14 are oppositely disposed on inner edges of the receptacle 12. Each of two ends of each first assembling body 14 is formed with a perforation 42. The middle section of the first assembling body 14 is formed with at least one first insertion slit 44.

The pair of second assembling bodies 16 are slat bodies with predetermined length. Two ends of each second assembling body 16 are respectively formed with two bending sections 62 transversely extending by a certain length in reverse directions. The bending sections 62 are respectively inserted in the perforations 42 of the first assembling body 14 to form a rectangular frame.

Two ends of the first partitioning slat 18 are respectively inserted in the first insertion slits 44 to partition the interior space of the receptacle 12.

Referring to FIGS. 5A to 5D, the bending sections 62 of the second assembling bodies 16 are inserted in the perforations 42 of the first assembling bodies 14 to form a frame. The assembling procedure includes steps of:

1. arranging the second assembling bodies 16 on upper and lower sides between the first assembling bodies 14;
2. respectively fitting the bending sections 62 of the second assembling bodies 16 through the perforations 42 of the first assembling bodies 14; and
3. pulling the first assembling bodies 14 outward to form a frame four corners of which are connected.

According to the above arrangement, the receptacle partitioning structure 1 of the present invention has the following advantages:

1. The four corners of the frame composed of the first and second assembling bodies 14, 16 are connected. Therefore, the frame can be firmly placed on inner edge of the receptacle 12.
2. The frame can be readily and conveniently disassembled without using any tool.
3. The receptacle partitioning structure can be mass-produced to lower the manufacturing cost. Moreover, the receptacle partitioning structure can be reliably added to those receptacles which originally have no partitioning structure.

The middle section of the second assembling body 16 can be found with at least one second insertion slit 64. The middle section of the first partitioning slat 18 is formed with at least one split 82 having an open end. The present invention further includes a second partitioning slat 19 with a certain length.

Two ends of the second partitioning slat are respectively inserted in the second insertion slits 64 of the second assembling bodies 16. The middle section of the second partitioning slat is formed with at least one split having an open end for inserting into the split 82 of the first partitioning slat 18. Accordingly, the first partitioning slat 18 and the second partitioning slat latitudinally and longitudinally intersect each other to partition the interior space of the receptacle into more compartments.

The above embodiments are only used to illustrate the present invention, not intended to limit the scope thereof. Many modifications of the above embodiments can be made without departing from the spirit of the present invention.

What is claimed is:

1. A receptacle partition structure comprising:

a) a receptacle being a rectangular body having a rectangular interior and an upper opening;

b) a pair of first assembling bodies, each of the pair of first assembling bodies being a slat body and having:

I) two holes, one of the two holes is located at each of two opposing ends of each of the pair of first assembling bodies; and ii) at least one first insertion slit located in a middle section thereof;

c) a pair of second assembling bodies, each of the pair of second assembling bodies being a slat body and having two bending sections, one of the two bending sections is located at each of two opposing ends of each of the pair of second assembling bodies, one of the two bending sections of each of the pair of second assembling bodies is inserted into each of the two holes of each of the pair of first assembling bodies, the pair of first assembling bodies and the pair of second assembling bodies are alternatingly positioned in the rectangular interior of the receptacle; and d) a first partitioning slat having two ends, one of the two ends is inserted into one of the at least one first insertion slit of each of the pair of first assembling bodies.

2. The receptacle partition structure according to claim 1, further comprising a second partitioning slat having two ends, the first partitioning slat having at least one split located on a middle section and having an open end, each of the pair of second assembling bodies having at least one second insertion slit located in a middle section thereof, one of the two ends of the second partitioning slat is inserted into one at least one second insertion slit of each of the pair of second assembling bodies, and a middle portion of the second partitioning slat is inserted into the at least one split of the first partitioning slat.

* * * * *